US010100527B1

(12) United States Patent
Moeller et al.

(10) Patent No.: US 10,100,527 B1
(45) Date of Patent: Oct. 16, 2018

(54) HOLLOW BALUSTER INSTALLATION SYSTEM

(71) Applicant: David W. Moeller, Flowery Branch, GA (US)

(72) Inventors: David W Moeller, Flowery Branch, GA (US); Keith Johnson, Plano, TX (US)

( * ) Notice: Subject to any disclaimer, the term of this patent is extended or adjusted under 35 U.S.C. 154(b) by 0 days.

(21) Appl. No.: 15/330,562

(22) Filed: Oct. 11, 2016

Related U.S. Application Data

(60) Provisional application No. 62/284,920, filed on Oct. 13, 2015.

(51) Int. Cl.
*E04F 11/18* (2006.01)
*E04H 17/22* (2006.01)
*E04H 17/14* (2006.01)

(52) U.S. Cl.
CPC ..... *E04F 11/1812* (2013.01); *E04F 11/1808* (2013.01); *E04F 11/1814* (2013.01); *E04F 11/1817* (2013.01); *E04F 11/1836* (2013.01); *E04H 17/1421* (2013.01); *E04H 17/22* (2013.01); *E04F 2011/1823* (2013.01); *Y10T 29/49826* (2015.01)

(58) Field of Classification Search
CPC ..... E04F 11/1808; E04F 11/1812; E04F 11/1814; E04F 11/1817; E04F 11/1836; E04F 11/1846; E04F 2011/1819; E04F 2011/1821; E04F 2011/1823; E04F 2011/1827; E04H 17/1421; E04H 17/22; F16B 3/06; F16B 7/02; Y10T 29/49826
USPC ..... 256/65.01, 65.02, 65.08, 65.14, 66; 29/428
See application file for complete search history.

(56) References Cited

U.S. PATENT DOCUMENTS 4,403,767 A 9/1983 Basey
5,037,232 A * 8/1991 Pakdipanichpong ..... F16B 7/02 108/150
5,876,021 A 3/1999 Spence et al.
6,141,928 A * 11/2000 Platt ..... E04F 11/1812 256/65.14
6,290,212 B1 * 9/2001 Bartel ..... E04F 11/1812 256/65.14
6,311,957 B1 11/2001 Driscoll et al.
6,736,373 B2 5/2004 Greaves
6,758,460 B1 7/2004 Driscoll et al.
7,044,448 B1 * 5/2006 Jones ..... E04F 11/181 256/65.01
7,055,807 B2 * 6/2006 Pesta ..... E04H 12/2269 256/65.14
7,503,732 B2 3/2009 Byrd
7,614,612 B2 11/2009 Edwards
7,909,311 B2 3/2011 Edwards
(Continued)

FOREIGN PATENT DOCUMENTS

CA 2 851 471 A1 9/2014
DE 19522095 A1 * 1/1997 ..... E04C 3/00
(Continued)

*Primary Examiner* — Josh Skroupa
(74) *Attorney, Agent, or Firm* — James K. Poole, Esq.

(57) ABSTRACT

Hollow baluster installation system that utilizes either the mounting holes that remain from the removal of a previous wooden baluster or newly drilled holes and components including a bottom plug, baluster insert and top cap which allow for installation of the hollow baluster in a staircase or railing.

11 Claims, 8 Drawing Sheets

(56) References Cited

U.S. PATENT DOCUMENTS

| | | | | |
|---|---|---|---|---|
| 8,418,335 | B2 | 4/2013 | Edwards | |
| 8,978,337 | B2 | 3/2015 | Edwards | |
| 2004/0025452 | A1 | 2/2004 | McLean | |
| 2004/0089858 | A1 * | 5/2004 | DeRogatis | E04F 11/181 256/59 |
| 2005/0278926 | A1 | 12/2005 | Moore et al. | |
| 2010/0237309 | A1 | 9/2010 | Ferris et al. | |
| 2011/0147687 | A1 | 6/2011 | Sgarglia | |
| 2011/0271481 | A1 | 11/2011 | Ma | |
| 2013/0020546 | A1 | 1/2013 | Truckner | |
| 2014/0034889 | A1 | 2/2014 | Edwards | |
| 2014/0217347 | A1 | 8/2014 | Green | |
| 2014/0246639 | A1 | 9/2014 | Lee | |
| 2015/0211235 | A1 | 7/2015 | Sneith et al. | |

FOREIGN PATENT DOCUMENTS

| | | | | |
|---|---|---|---|---|
| DE | 20307316 | U1 | 9/2003 | |
| DE | 10331925 | A1 | 2/2005 | |
| EP | 2 746 486 | A2 | 6/2014 | |
| FR | 2196655 | A1 * | 4/1974 | E04F 11/18 |
| WO | WO 9113222 | A1 * | 9/1991 | E04F 11/1812 |

* cited by examiner

HOLLOW BALUSTER INSTALLATION SYSTEM

CROSS REFERENCE TO RELATED APPLICATION

This application claims the benefit of Applicant's provisional application, U.S. 62/284,920, filed on Oct. 13, 2015 for "METAL BALUSTER INSTALLATION SYSTEM".

This application is not a result of federally sponsored research or development.

BACKGROUND OF THE INVENTION

1. Field of the Invention

The present invention relates to a set of specialty hardware designed to allow for the easy and rapid installation of hollow balusters into the holes remaining in the treads and hand rail following the removal of wooden balusters from an existing stairway.

2. Description of Relevant Art

Balusters provide a physical barrier to the passage of children and pets under the hand rail of open stairways and balconies and thus prevent a dangerous fall. In addition to their utilitarian value, they also contribute to the aesthetics of the stairway or balcony.

They are offered in a variety of decorative designs and are manufactured from wood, solid metal bars, hollow metal tubes and other materials. As such, there are times when the repair, renovation, or modification of an existing stairway requires the removal and replacement of the existing balusters.

Wooden balusters are typically installed by drilling a hole, usually ¾ inch in diameter, into the upper face of the edge of the stair tread and a second hole, usually ¾ inch in diameter, into the underside of the hand rail directly above the hole in the upper face of the tread. The wooden balusters are produced with a cylindrical pin, typically ¾ inch in diameter and ¾ inch high, at the bottom of the baluster that fits into the hole in the tread. The top of the baluster is either shaped so that it tapers down to a diameter of ¾ inch at the top or has a square top that can be cut either horizontally or at an angle and then drilled. A ¾ inch diameter pin can then be installed that fits into the corresponding hole in the underside of the rail. Wooden balusters are produced in a range of specific heights that correspond to the heights required to span the gap between the tread and the handrail as it either rises with the stairs or is mounted horizontally along a balcony or landing.

The sequence that the parts of a staircase are initially installed is for the treads and risers to be installed first followed by the newels. The treads are then drilled for the base of the balusters and the balusters are then stood up in the holes. The rail is then drilled on the underside to receive the tops of the balusters. The rail is then installed by lowering it and inserting the upper ends of each balusters into the holes drilled in the rail. The rail is then secured at its ends to the walls and/or newels. As a result the balusters are held at either end and can't be removed without damaging them. The installation is then completed by rotating the balusters into alignment and locking them into place by securing the base and top using glue or a fine wire nail.

Metal balusters, hollow or solid, are typically installed by drilling a ½ or ⅝ inch hole into the underside of the rail which matches the upper pin end of the metal baluster. The pin end of the baluster is cylindrical in shape and ½ or ⅝ inch in diameter and typically ¾ inch long. The lower end of the metal baluster is not fitted with a pin and can't be nailed, so a hole of ¾ or 15/16 inch in diameter is drilled about 1 inch deep into the upper face of the stair tread or floor. The bases of the metal balusters are inserted into the holes in the tread or floor and are allowed to rest upright in the holes. The rail is then slowly lowered into place and the individual metal balusters are manually brought into a vertical position and into alignment with the hole in the underside of the rail. The rail is then secured at its ends into the walls and/or newels. At this point the metal balusters are only partially secured in place. To fully secure them, each metal baluster is rotated into alignment and moved into its correct position and a spring clamp or wedge is used to hold it in place. Then a commercial adhesive or epoxy is prepared and poured or injected into the hole in the tread or floor. The metal baluster is then held in place until the adhesive or epoxy has dried or cured. Decorative covers know as shoes are then set in place to cover and hide the base attachment point of the metal baluster and/or the top attachment point of the metal baluster. These decorative shoes are typically made from cast metal, are painted or powder coated to match the baluster's finish, have an open base that is either flat or angled, and a top that narrows to an opening that matches the size and shape of the baluster shafts. The shoes are fitted with mechanical fasteners, typically set screws, to secure them in place over the shafts of the balusters. These shoes are commercially available from sellers of stair parts such as Home Depot, Lowe's and others.

Prior art exists that presents different systems to improve upon the traditional installation method for iron balusters. The following is a listing of that prior art along with a summary of the prior art, its benefits and limitations: Driscoll et. al., U.S. Pat. No. 6,311,957 B1 and U.S. Pat. No. 6,758,460 B1, describes a flat: and angled adaptor that is designed to secure the square end of a metal baluster into a purpose drilled hole in the tread and rail. In addition it describes a flat and angled extruded piece designed to fit over the metal baluster and be secured to the baluster where the baluster meets the rail or tread and for the purpose of covering and hiding the hole that the metal baluster is inserted into. Finally, it describes a flat and angled connector designed to be slid over the ends of the metal baluster and be secured to the flat surface on the face of the tread or underside of the rail with nails or built in pins. The benefit of these connectors is that the time, mess and cost of using adhesive to secure the metal baluster in the hole is eliminated. While some of the connectors described are only suitable for new installation, the described surface mounted connector that slides over the baluster could be used to secure a replacement metal baluster in the place of a wooden baluster in an existing stairway (provided one or both of the mounting holes for the wooden baluster were plugged with a wooden plug that was secured in place, then trimmed and sanded flush to the face of the tread and/or rail surface). One limitation of using these connectors to secure a replacement metal baluster is that they require accurate measurement of the distance from the tread or floor to the rail and then precise cutting of the metal baluster so that the connectors will hold the metal baluster in the correct location at the correct alignment. Another limitation is that the angled connectors described are made at a fixed angle. The angle of rise of the hand rail is aligned with the angle of rise of the stairs. Building codes typically allow for a range of acceptable angles of rise and the codes often vary by state and have been revised over time. As such there is no standard angle of rise and any connector with a fixed angle will likely need to be modified in the field to align with and secure the metal baluster properly in an existing stairway. Edwards, U.S. Pat. No. 7,614,612 B2, U.S. Pat. No. 7,909,311 B2, U.S. Pat. No. 8,418,335 B2 and U.S. Pat. No. 8,978,337 B2, and Sgariglia, US 2011/0147687, describe a metal baluster that is adjustable in height and a set of fixed and/or pivoting connectors designed to mount to the flat faces of the tread and rail. A benefit of this system is that the adjustability of the metal balusters eliminates the need for accurate measuring and cutting to achieve a good fit and the time, mess and cost of the adhesive is eliminated. The connectors also anticipate the potential for a variety of angles of rise and have been designed to pivot if required. A limitation of this system is that the adjustable metal balusters are more complex and costly to produce and the balusters and connectors are designed as a system so the user can't choose to select other metal balusters they may prefer due to design, color, price or availability without having to significantly modify them to work with the connectors. Lim, U.S. Pat. No. 7,971,412, and Green, US 2014/0217347, describe attachment systems for hollow metal balusters that utilize mounting devices that are attached by screws or nails to the upper faces of the treads and that in turn secure themselves to the bases of the metal balusters. For these systems the upper end of the metal baluster is secured by the drilling of a correctly sized hole into the underside of the hand rail to fit the existing pin at the top of the metal baluster. In order for the baluster to be well secured, the span between the face of the tread and the bottom of the rail must be accurately measured and calculations made so that each hollow metal baluster is accurately cut to the correct length. The benefit of these systems is that they provide for the securing of the bases of the hollow metal balusters without need of the expense, mess, and time required for an adhesive. The attachment systems are then hidden by decorative shoes.

Sneith, US 2013/0214228, and Truckner, US 2013/0328004, describe attachment systems that are screwed or nailed to both the underside of the hand rail and to the upper faces of the treads to allow for the tops and bottoms of the metal balusters to be secured to them. In order for the baluster to be well secured, the span between the face of the tread and the bottom of the rail must be accurately measured and calculations made so that each hollow metal baluster is precisely cut to the correct length. The benefit of these systems is that they also provide for the securing of the bases of the metal balusters without need of the expense, mess, and time required for an adhesive. The attachment systems are then hidden by decorative shoes. A limitation of these systems is that any holes from the previous balusters have to be plugged, then trimmed and sanded flush before they are installed. DeRogatis, et. al., U.S. Pat. No. 7,762,533, and McLean, US 2004/0025452, describe attachment systems that utilize the drilling of small diameter holes into the undersides of the handrails and into the upper face of the tread or lower rail to allow for an insert to be screwed or pressed into the hole. The insert has a portion that extends above the tread or lower rail and below the handrail that attaches to the baluster. In order for the baluster to be well secured, the span between the faces of the treads or lower rail and the bottom of the upper rail must be accurately measured and calculations made so that each hollow metal baluster is accurately cut to the correct length. The benefit of these systems is that they also provide for the securing of the base of the metal baluster without need of the expense, mess, and time required for an adhesive. The attachment systems then can be hidden by decorative shoes. A limitation of these systems is that any holes from the previous balusters have to be plugged, then trimmed and sanded flush before holes that the connectors require can be drilled at the correct size and angle.

These existing metal baluster attachment systems are designed primarily for use in new installations. For existing stairways that have already been fitted with wooden balusters, changing to metal balusters using one of these systems is difficult as the pre-existing drill holes in the underside of the rail are too large for a tight fit of the top of the metal baluster. These pre-existing holes would need to be plugged or filled so that a smaller diameter hole to secure the upper baluster pin or a threaded insert could be drilled or so they don't interfere with the secure surface mounting of one of the existing upper attachment systems. Likewise, the drill holes in the treads would need to be plugged or filled so that they don't interfere with the secure mounting of one of the existing surface mounted attachment systems or the drilling of a small diameter hole for a connector insert. In view of the foregoing disadvantages and limitations found in the prior art methods of securing hollow balusters into stairways that had been previously fitted with wooden balusters, there is an interest in and need for an improved hollow baluster mounting system, especially one that works with the standard commercially available metal balusters.

SUMMARY

In one embodiment, a kit is provided for installing a plurality of hollow balusters to support a stairway handrail, including a set of three components for each baluster, which are a) a bottom plug formed as a round truncated cone with a diameter adapted to permit firm seating of the bottom plug into a hole drilled in a stair tread or floor to which the baluster is to be fastened; b) a baluster insert adapted to be inserted and seated in the hollow base of a hollow baluster; and c) a top cap formed as a round truncated cone with the narrow end having a solid outer surface and the wider end containing a round recess within which is adapted to fit over the top end of the baluster, and the narrow end adapted to be inserted into and seated in a hole drilled in the underside of the handrail. Additional features including roughening the outer surface of the bottom plug sufficiently to facilitate its firm seating within the hole in the tread or floor into which it is to be placed. Such roughening can take the form of protruding ridges parallel to the sides of the cone to enhance the permanent seating of the plug in the hole. The recess in the top surface of the bottom plug can be adapted to receive and retain the head of a threaded bolt (e.g., a hexagonal or square head) used to engage the lower portion of the baluster insert.

The baluster insert can include a tapered plug with a cross-section adapted to permit it to be inserted and seated by friction within the hollow base of the hollow baluster. The plug further includes a female threaded hole through the insert which is adapted to receive a threaded bolt which inserts into the shaped recess in the upper portion of the bottom plug. The tapered plug can have a cross section which is substantially rectangular or square in certain embodiments and may be round in other embodiments. The balusters, which are commercially available, can be fabricated of materials which are primarily metal, polymeric or composite materials: The balusters generally have cross sections which are substantially rectangular or square but there are some balusters that have a circular cross section. In addition to the components described above, the kits can include commercially available decorative shoes designed to conceal the components attaching to the stair treads or floor, the shoes being formed to cover the lower plug as installed and present a decorative exterior surface. Further embodiments include methods of installing a plurality of hollow balusters to support a stairway or barrier handrail, including steps of: a) removing at least a portion of the existing wooden balusters; b) inserting and seating a bottom plug having the form of a truncated cone into an existing or newly-drilled hole in a stair tread or floor; selecting baluster inserts to fit the balusters to be used, the inserts having tapered portions adapted to fit and seat firmly within the lower portions of the hollow baluster and having a female threaded hole at the opposite end of the baluster insert; d) inserting and seating the baluster inserts within the lower portions of the hollow balusters; e) fitting the recess in the top of the larger end of a top cap having the form of a round truncated cone over the top of each baluster; f) inserting the upper, smaller ends of each top cap firmly into holes drilled into the underside of the hand rail; g) fitting to full depth a threaded bolt into the threaded holes in each baluster insert; h) inserting the head of each threaded bolt into the corresponding recesses in the upper surfaces of each bottom plug; and then, i) rotating each hollow baluster so that the threaded bolt in the baluster insert is extended out of the baluster insert and by extending it the top cap, baluster and bottom plug become firmly seated between the hand rail and the tread or floor below.

Optionally, an additional step includes inserting the top and/or bottom ends of the baluster into commercially available decorative shoes prior to applying the top cap and baluster insert. After installation of the baluster, the decorative shoes can be slid upwards and/or downward to cover the attachment area and be locked in place using the set screws fitted to the decorative shoes.

The method of installing a plurality of hollow balusters to support a hand rail over stair treads or a floor, as a new installation, includes similar steps, but does not require the removal of existing balusters. The steps would include: a) inserting and seating a bottom plug having the form of a truncated cone in each hole which has been drilled to accommodate such plugs in a stair tread or floor; b) selecting baluster inserts to fit the balusters to be used, each baluster insert having a tapered portion adapted to fit and seat firmly within the lower hollow portion of each hollow baluster and also a female threaded hole at the opposite end of each baluster insert; c) inserting and seating each baluster insert within the lower portions of the hollow balusters; d) fitting the recesses in the tops of the larger ends of each of a plurality of top caps having the form of a round truncated cone, over the top of each baluster; e) inserting the upper, smaller end of each top cap firmly into holes drilled into the undersides of the hand rail; f) fitting to full depth a threaded bolt into the threaded hole in each baluster insert; g) inserting the head of each threaded bolt into a corresponding recess in the upper surfaces of each bottom plug; and then, h) rotating each hollow baluster so that the threaded bolt in the baluster insert is extended out of the baluster insert and by extending it the top cap, baluster and bottom plug become firmly seated between the hand rail and the tread or floor below.

As with the installation of hollow balusters to replace existing wooden balusters, decorative shoes can be installed on the upper and/or lower plugs for each newly-installed baluster to conceal the plugs and create a more decorative appearance.

BRIEF DESCRIPTION OF THE DRAWINGS

The invention will be better understood and aspects other than those set forth above will become apparent when consideration is given to the following detailed drawings. The same numerals are used to designate like components in these figures.

Such description makes reference to the annexed drawing wherein.

DETAILED DESCRIPTION OF PREFERRED EMBODIMENTS

In the following description, a terrestrial frame of reference is employed, with the "top" of a component being the part that is uppermost when in use and the "bottom" being opposite. The term "A and/or B" is used in the sense that A alone, B alone, or both A and B may be present.

Figure 1:
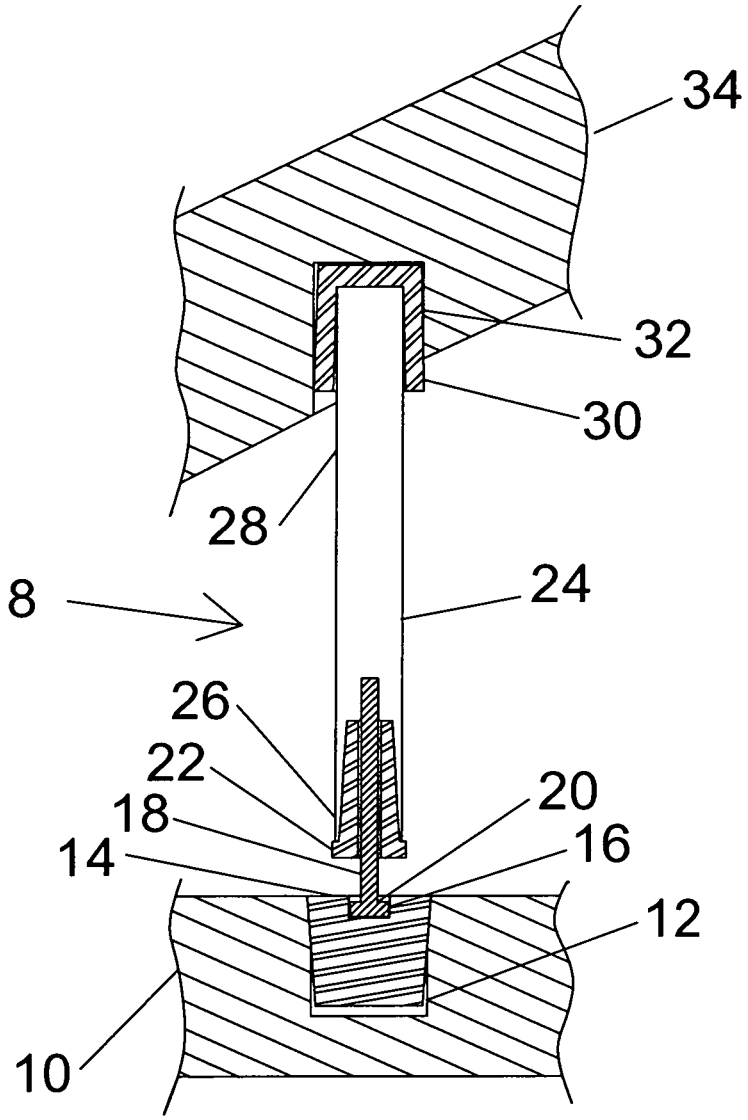
FIG. 1 is a sectional drawing showing a hollow metal baluster installed using the components described in the specification.

With reference to FIG. 1, a tread or floor section (10) is shown with an existing or drilled hole (12) in it and a baluster (24) installed with a kit (8). Kit (8) comprises a top cap (30), a baluster insert (22) and a bottom plug (14). The bottom plug (14) has been driven and seated into the hole (12). The baluster insert (22) has had the threaded bolt (18) installed therein and has been firmly seated into the bottom end (26) of the baluster (24). The upper end (28) of the baluster (24) has been inserted into the top cap (30) which has in turn been inserted into the existing or newly drilled hole (32) in the underside of the rail (34). The head (20) of the threaded bolt (18) has been inserted into the shaped recess (16) in the top of the bottom plug (14) and in turn the baluster (24) has been rotated extending the threaded bolt (18) out of the baluster insert (22) a sufficient distance so that the baluster (24) is firmly secured between the tread or floor (10) and the rail (34).

Figure 2C:
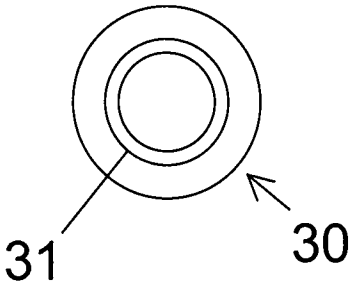
FIGS. 2A, 2B and 2C are sectional, top and bottom views of the top cap for a ½" baluster.
Figure 2B:
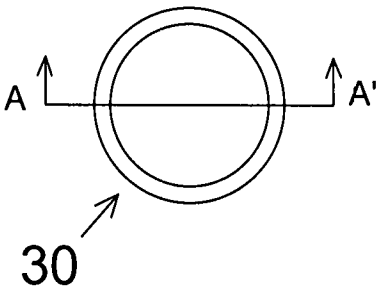
Figure 2A:
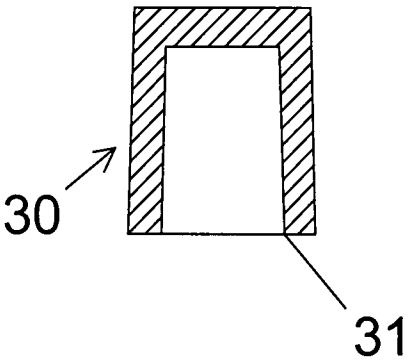

With reference to FIG. 2, the sectional (2A), top (2B) and bottom (2C) views of a top cap (30) sized to work with a ½" baluster (for example) are shown. The top cap (30) can be composed of rubbery materials, thermoplastic polymers or composites, cast metal, or other suitable materials depending upon the compressibility and durability desired. A thermoplastic or rubbery material that will allow it to be compressed and conform around both the top end (28) of the baluster (24) and into the hole (32) would be preferable. The tapered dimensions shown for the outside diameters of the top cap (30) and the inside diameters of the hole (31) are exemplary of the clearances required to fit on the top end (28) of the baluster (24) and into the hole (32) in a rail (34).

Figures 3B, 3C:
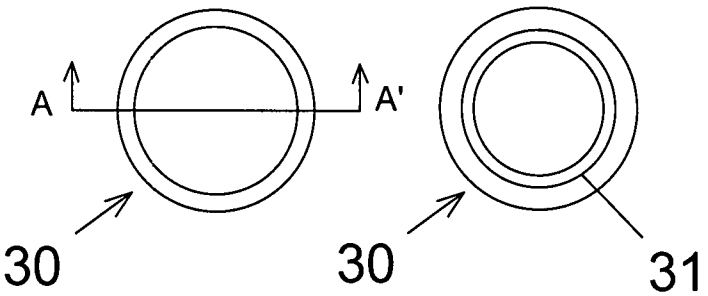
FIGS. 3A, 3B and 3C are sectional, top and bottom views of the top cap for a ⅝" baluster.
Figure 3A:
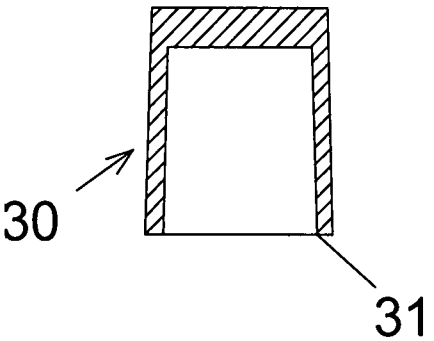

With reference to FIG. 3, the section (3A), top (3B) and bottom (3C) views of a top cap (30) sized to work with a ⅝" baluster (for example) are shown. The outside diameter and inside diameter of hole (31) are tapered (bottom to top) as discussed for FIGS. 2A-2C.

Figures 4A, 4B, 4C:
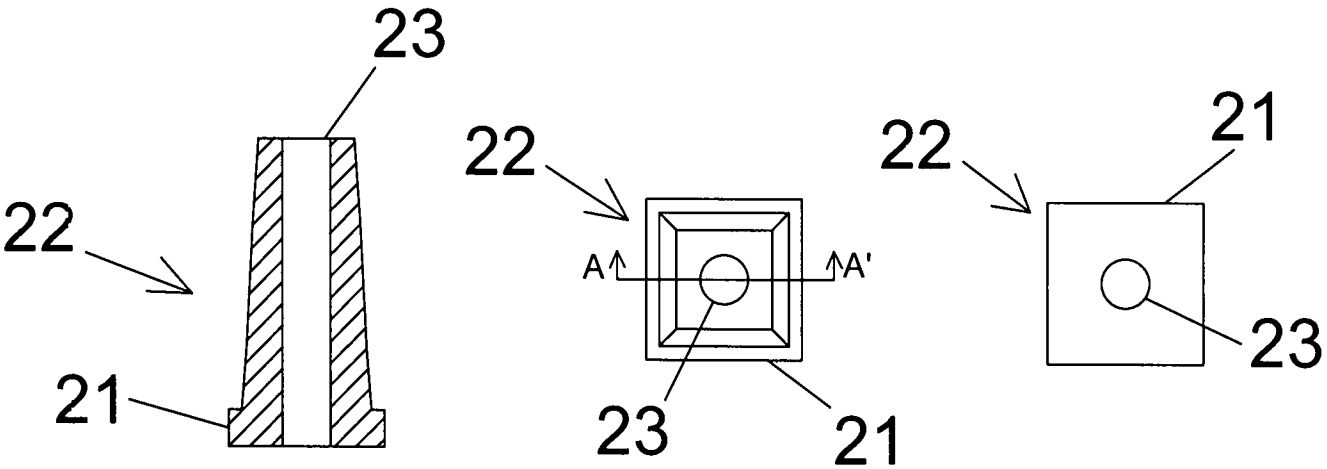
FIGS. 4A, 4B and 4C are sectional, top and bottom views of the baluster insert for a ½" square baluster.

With reference to FIG. 4, the section (4A), top (4B) and bottom (4C) views of a baluster insert (22) sized to work with a ½" baluster with a square cross section are shown. The diameter and thread pitch of the threaded hole (23) that goes through the baluster insert (22) can be altered to match the diameter and thread pitch of the threaded bolt (not shown) selected for use. The treads can be cut or molded into the material of which baluster insert (22) is made, provided it is metal or other hard polymer or composite. A fine thread for the threaded bolt is preferable as it allows for balusters with designs that need to be aligned with the rail to be twisted into alignment more easily. The baluster insert can be composed of thermoplastic polymers, composites, cast metal, or other suitable material depending on the strength and durability desired. A cast metal of sufficient strength to allow for a threaded hole to be made in it would be preferable but a threaded insert sleeve could be utilized if a material of reduced hardness is used. The baluster insert (22) is tapered from a cross section that is slightly smaller than the opening in the bottom end (26) of a hollow baluster (24) to a cross section that is slightly larger than the opening at the bottom end (26) of a hollow baluster (24). In other words, the baluster insert (22) has the form of a slender, square truncated pyramid. Below the tapered section of baluster insert (22) is a section that has an abrupt change in size and forms a shoulder (21). This shape allows for the baluster insert (22) to be partially inserted into the bottom end (26) of the hollow baluster (24), as seen in FIG. 1. After the baluster insert (22) has been partially inserted into the bottom end (26) of the hollow baluster (24), the baluster insert (22) is driven into the bottom end (26) of the hollow baluster (24) using a hammer, press or other method to the point that the shoulder (21) of the baluster insert (22) comes in contact with the bottom end (26) of the hollow baluster (24), as seen in FIG. 1.

Figure 5:
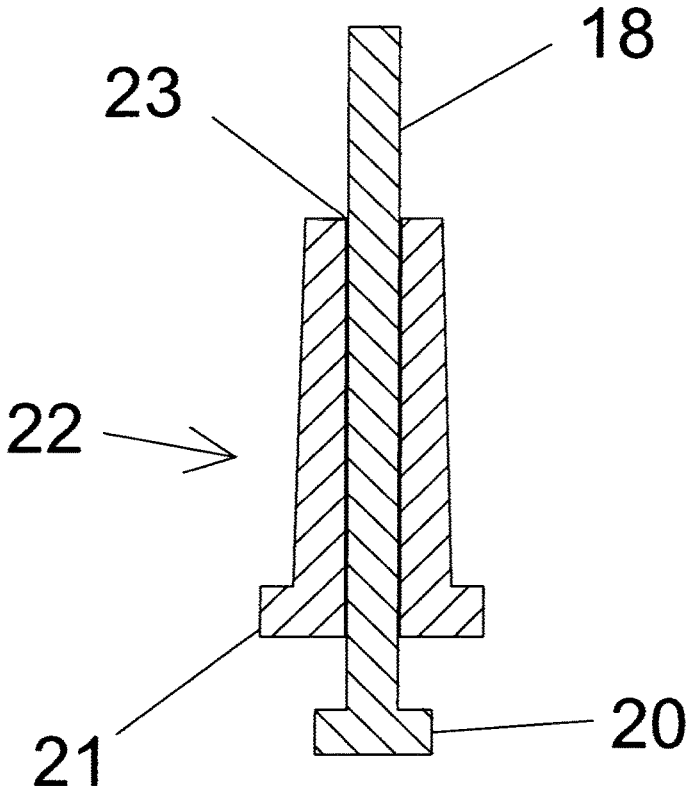
FIG. 5 is a sectional view of a square baluster insert with the threaded bolt installed.

In FIG. 5, a sectional view of a baluster insert (22) is shown with the bolt (18) installed so that the bolt head (20) is located below the shoulder (21) of the baluster insert (22) and the bolt (18) is almost fully seated into the baluster insert (22). The intersection of the treads of bolt (18) and the interior of the baluster insert (22) are omitted for clarity.

Figures 6A, 6B, 6C:
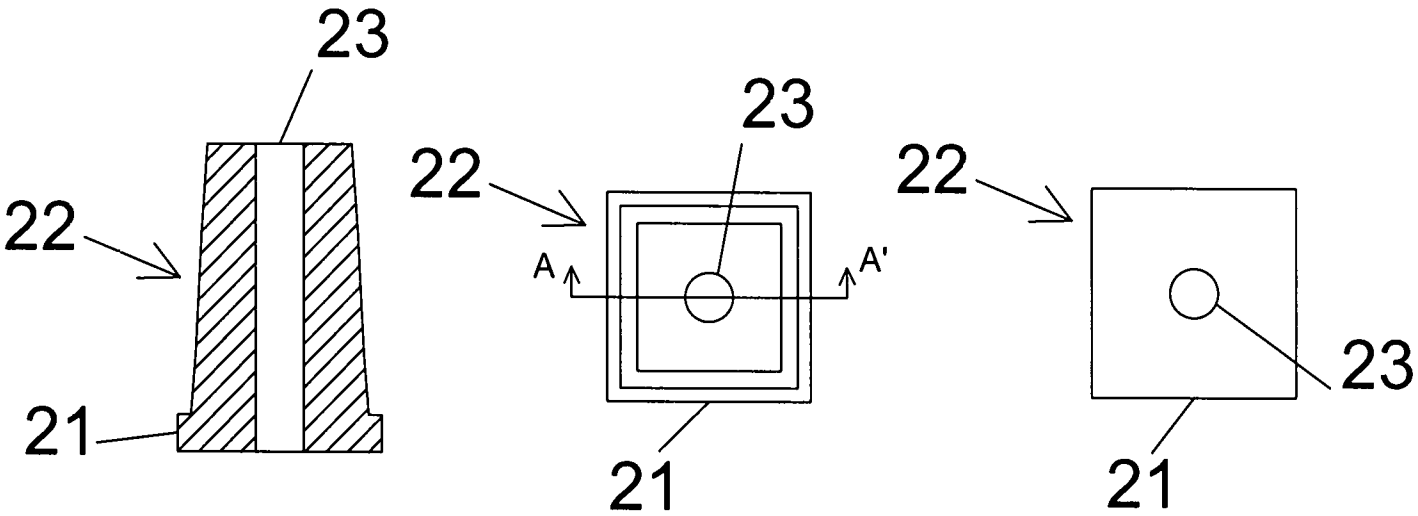
FIGS. 6A, 6B and 6C are sectional, top and bottom views of the baluster insert for a ⅝" square baluster.

FIG. 6 shows sectional (6A), top (6B) and bottom (6C) views of a baluster insert (22) sized to work with a ⅝" baluster with a square cross section and fitted with a threaded hole (23) and shoulder (21).

Figure 7B:
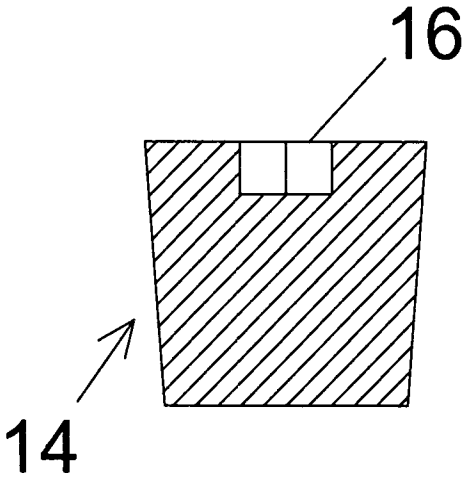
FIGS. 7A and 7B are top and sectional views of the bottom plug.
Figure 7A:
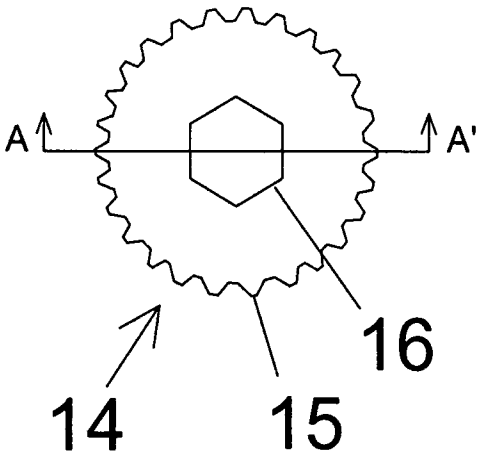

With reference to FIG. 7, the top (7A) and sectional (7B) views of a bottom plug (14) are shown. The exterior surface of the sides of bottom plug (14) are shown with optional ridges (15) to prevent the bottom plug (14) from twisting in the hole after it is inserted. In other words, the exterior of the plug is roughened or machined (as in knurling) to keep the plug in place once seated. Ridges (15) are only one version of this surface treatment. The dimensions and shape shown for the recess (16) in the top surface can be altered to match the size and shape of the head of the threaded bolt (18) used in the baluster insert (22), and will normally be hexagonal or square. The bottom plug (14) can be composed of thermoplastic polymers, composites, cast metal, or other suitable material depending on the strength and durability desired.

The dimensions shown on the previous figures represent estimated values and are presented to provide a better understanding of the approximate size, shapes and tapers of the top cap, baluster insert and bottom plug for two sizes and shapes of balusters. One or more of the dimensions shown may be altered to improve the functionality and fit of the described specialty hardware kit.

Figure 8B:
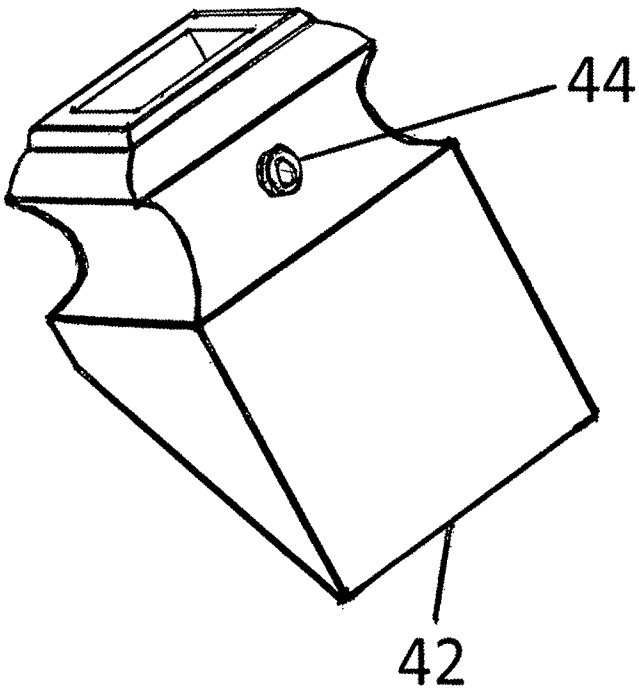
FIGS. 8A and 8B are perspective views showing two types of commercially available decorative shoes for both flat and angled applications.
Figure 8A:
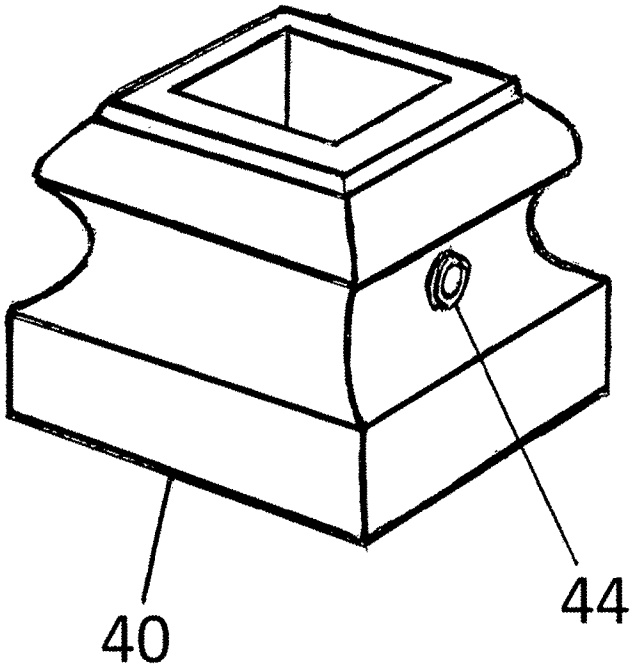

With reference to FIG. 8, the devices shown are of commercially available decorative flat (40) and angled (42) "shoes" that may be used to cover and hide the described attachment hardware at the top and/or bottom of the baluster. The flat shoe (40) is typically used where a vertical baluster is mounted into the horizontal surface of the tread or floor and/or where the baluster is mounted into the underside of a horizontal railing. The angled shoe (42) is made with a slope that is close to the angle at which the majority of stairways are constructed. The angled shoe (42) is typically used when a vertical baluster is mounted into the underside of a rail that is sloped. Both types of shoes are typically fitted with a set screw (44) that secures the shoe in place by tightening the set screw (44) against the shaft of the baluster (24).

In the foregoing description, certain terms have been used for brevity, clarity and understanding. All equivalent relationships to those illustrated in the drawings and described in the preferred embodiment are to be encompassed by this present invention to produce the intended results. It is also to be understood that the following claims are intended to cover all of the generic and specific features of the embodiments described herein, and all statements of the scope of the invention which, as a matter of language, might be said to fall therebetween.

Having thus described and disclosed preferred embodiment of our invention, what we claim as our invention is:

1. A kit for installing a plurality of hollow balusters, each having a hollow base and a substantially square or rectangular cross-section, to support a hand rail, comprising a set of three components for each baluster, said components comprising:

a) a bottom plug formed as a round truncated cone with a diameter adapted to permit seating by friction of said bottom plug in a hole drilled in a tread or floor to which the baluster is to be fastened, wherein the outer surface of said bottom plug is roughened sufficiently to facilitate seating by friction of said plug in said hole;

b) a baluster insert adapted to be inserted and seated by friction in the hollow base of said hollow baluster; and c) a top cap formed as a round truncated cone with the narrow end having a solid outer surface and the wider end containing a recess therein which is adapted to fit over the top end of said baluster, said plug being adapted to have the narrow end inserted into and seated in a hole drilled in the underside of said hand rail.

2. The kit of claim 1 wherein said baluster insert comprises a tapered plug with a cross-section adapted to permit it to be inserted and seated by friction within the hollow base of said hollow baluster and further comprises a female threaded hole in the base of said plug adapted to receive a threaded bolt.

3. A kit for installing a plurality of hollow balusters to support a hand rail, each baluster having a hollow base, comprising a set of three components for each baluster, said components comprising:

a) a bottom plug formed as a round truncated cone with a diameter adapted to permit seating by friction of said bottom plug in a hole drilled in a tread or floor to which the baluster is to be fastened, wherein said bottom plug comprises protruding ridges extending longitudinally along the outer surface of said cone to keep said plug in place in said hole once seated, and wherein said bottom plug comprises a recess in the top surface of the plug adapted to receive and retain the head of a threaded bolt used to engage the lower portion of said baluster insert;

b) a baluster insert adapted to be inserted and seated in the hollow base of said hollow baluster, said baluster insert comprising a tapered plug with a cross-section adapted to permit it to be inserted and seated by friction within the hollow base of said hollow baluster and further comprises a female threaded hole in the base of said plug adapted to receive a threaded bolt having a head;

c) a top cap formed as a truncated right circular cone with the narrow end having a solid outer surface and the wider base end containing a round recess therein which is adapted to fit over the top end of said baluster, said plug being adapted to have the narrow end inserted into and seated by friction in a hole drilled in the underside of said hand rail.

4. The kit of claim 3 wherein said tapered plug has a cross section which is substantially rectangular or square.

5. The kit of claim 3 wherein said tapered plug has a cross section which is substantially round.

6. The kit of claim 3 wherein said balusters comprise primarily metal, polymeric or composite materials.

7. The kit of claim 3 wherein said balusters have hollow bases and have cross sections which allow for the insertion of said baluster insert.

8. A method of installing a plurality of hollow balusters in place of existing wooden balusters, said balusters extending between said hand rail and a corresponding stair tread or floor, to support a hand rail, comprising steps of:

a) procuring said plurality of hollow balusters, each having a hollow base;

b) removing at least a portion of said existing wooden balusters, leaving existing holes in the corresponding stair tread or floor;

c) inserting and seating a bottom plug having the form of a truncated right circular cone in each existing hole in the corresponding stair tread or floor;

d) selecting baluster inserts to fit the size and shape of the balusters to be used, said inserts having tapered portions adapted to fit and seat by friction within the lower portion of said hollow baluster and having a female threaded hole at the opposite end of said insert; then inserting and seating said baluster inserts within said lower portions of said hollow balusters;

e) fitting a recess in the larger end of a top cap having the form of a truncated right circular cone over the top of said baluster;

f) inserting the upper, smaller end of said top cap firmly into holes drilled into the undersides of said hand rail;

g) fitting and fully seating a threaded bolt having a head into the threaded hole in said baluster insert;

h) inserting the head of said threaded bolt into a corresponding recess in the upper surface of said bottom plug; and then i) rotating said hollow baluster to extend said threaded bolt out of the baluster insert so as to seat said baluster by friction between said hand rail and said tread or floor.

9. The method of claim 8, further comprising steps of installing decorative shoes on the upper and/or lower plugs of each newly-installed baluster to conceal said plugs and create a decorative appearance.

10. A method of installing a plurality of hollow balusters, each having a hollow base, to support a hand rail, comprising steps of drilling holes in the underside of said hand rail and the corresponding stair tread or floor below, and then:

a) providing a set of hollow balusters;

b) inserting and seating a bottom plug having the form of a truncated right circular cone in each hole drilled in a stair tread or floor for such installation;

c) selecting baluster inserts to fit the balusters to be used, each said baluster insert having a tapered portion at a first end adapted to fit and seat by friction within the hollow base of said hollow baluster and a female threaded hole at the opposite end of said baluster insert;

d inserting and seating said baluster inserts within said hollow bases of said hollow balusters;

e) fitting a recess formed in the top of the larger end of a top cap having the form of a round truncated cone over the top of said baluster;

f) inserting the upper, smaller end of said top cap into holes drilled into the underside of said hand rail;

g) fitting and fully seating a threaded bolt having a head into the threaded hole in said baluster insert;

h) inserting the head of said threaded bolt into a corresponding recess in the upper surface of said bottom plug; and I) rotating said hollow baluster to extend said threaded bolt out of the said baluster insert so as to seat said baluster by friction between said hand rail and said tread or floor.

11. The method of claim 10, further comprising steps of installing decorative shoes on the upper and/or lower plugs of each newly-installed baluster to conceal said plugs and create a decorative appearance.

* * * * *